US010710227B2

(12) United States Patent
Pomeroy et al.

(10) Patent No.: US 10,710,227 B2
(45) Date of Patent: Jul. 14, 2020

(54) CONTROL SYSTEM FOR GAS SPRING FASTENER DRIVER

(71) Applicant: TTI (MACAO COMMERCIAL OFFSHORE) LIMITED, Macau (MO)

(72) Inventors: Edward Pomeroy, Piedmont, SC (US); Zachary Scott, Easley, SC (US); John Schnell, Anderson, SC (US); Essam Namouz, Greenville, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 237 days.

(21) Appl. No.: 15/807,730

(22) Filed: Nov. 9, 2017

(65) Prior Publication Data

US 2018/0126530 A1 May 10, 2018

Related U.S. Application Data

(60) Provisional application No. 62/419,863, filed on Nov. 9, 2016, provisional application No. 62/419,801, filed on Nov. 9, 2016.

(51) Int. Cl.

| | |
|---|---|
| ***B25C 1/04*** | (2006.01) |
| ***B25C 1/00*** | (2006.01) |
| ***B25C 1/06*** | (2006.01) |

(52) U.S. Cl.

CPC ..... *B25C 1/047* (2013.01); *B25C 1/008* (2013.01); *B25C 1/04* (2013.01); *B25C 1/06* (2013.01)

(58) Field of Classification Search

CPC ..... B25C 1/008; B25C 1/047; B25C 1/04; B25C 1/06; B25F 5/00

See application file for complete search history.

(56) References Cited

U.S. PATENT DOCUMENTS

| | | | | |
|---|---|---|---|---|
| 3,782,250 A * | 1/1974 | Kiszewski | ..... | F15B 11/06 91/433 |
| 4,104,907 A * | 8/1978 | Tsipouras | ..... | G01L 23/08 73/114.14 |
| 4,195,531 A * | 4/1980 | Okamura | ..... | G01L 23/08 123/676 |
| 5,027,015 A * | 6/1991 | Czarnocki | ..... | G01L 1/2275 327/516 |

(Continued)

FOREIGN PATENT DOCUMENTS

WO 2016199670 12/2016

OTHER PUBLICATIONS

European Patent Office Search Report for Application No. 17200927.6 dated Apr. 18, 2018, 8 pages.

*Primary Examiner* — Robert F Long
*Assistant Examiner* — Eduardo R Ferrero
(74) *Attorney, Agent, or Firm* — Michael Best & Friedrich LLP

(57) ABSTRACT

A fastener driver comprises a driver blade movable from a retracted position to an extended, driven position for driving a fastener into a workpiece, a gas spring mechanism for driving the driver blade from the retracted position to the driven position, the gas spring mechanism including a storage chamber cylinder containing a pressurized gas, means for determining a pressure in the storage cylinder chamber, and an indicator activated in response to the determined pressure in the storage cylinder chamber being less than a predetermined pressure value.

14 Claims, 3 Drawing Sheets

(56) References Cited

U.S. PATENT DOCUMENTS

| | | | | |
|---|---|---|---|---|
| 5,187,985 | A * | 2/1993 | Nelson | G01L 1/2281 338/3 |
| 5,517,073 | A * | 5/1996 | Ohkuma | G01D 3/036 310/315 |
| 6,123,241 | A | 9/2000 | Walter et al. | |
| 6,722,550 | B1 | 4/2004 | Ricordi et al. | |
| 6,843,401 | B2 * | 1/2005 | Favre-Bulle | B25C 1/08 123/46 SC |
| 8,079,504 | B1 | 12/2011 | Pedicini et al. | |
| 2002/0158102 | A1 | 10/2002 | Patton et al. | |
| 2013/0082085 | A1 | 4/2013 | Largo | |
| 2013/0336809 | A1 * | 12/2013 | Antoun | F04B 19/00 417/53 |
| 2015/0158160 | A1 | 6/2015 | Kato | |
| 2016/0288305 | A1 | 10/2016 | McCardle et al. | |
| 2018/0154505 | A1 * | 6/2018 | Sato | B25C 1/008 |
| 2019/0065811 | A1 * | 2/2019 | Cao | G06K 9/0004 |

* cited by examiner

CONTROL SYSTEM FOR GAS SPRING FASTENER DRIVER

CROSS-REFERENCE TO RELATED APPLICATIONS

This application claims priority to U.S. Provisional Patent Application Nos. 62/419,863 and 62/419,801, both filed on Nov. 9, 2016, the entire contents of which are incorporated herein by reference.

FIELD OF THE INVENTION

The present invention relates to power tools, and more particularly to gas spring fastener drivers.

BACKGROUND OF THE INVENTION

There are various fastener drivers used to drive fasteners (e.g., nails, tacks, staples, etc.) into a workpiece known in the art. These fastener drivers operate utilizing various means (e.g., compressed air generated by an air compressor, electrical energy, flywheel mechanisms) known in the art, but often these designs are met with power, size, and cost constraints.

SUMMARY OF THE INVENTION

The present invention provides, in one aspect, a fastener driver comprising a driver blade movable from a retracted position to an extended, driven position for driving a fastener into a workpiece, a gas spring mechanism for driving the driver blade from the retracted position to the driven position, the gas spring mechanism including a storage chamber cylinder containing a pressurized gas, means for determining a pressure in the storage chamber cylinder, and an indicator activated in response to the determined pressure in the storage chamber cylinder being less than a predetermined pressure value.

The present invention provides, in another aspect, a method of operating a fastener driver. The method comprises initiating a fastener driving operation by moving a driver blade, with a gas spring mechanism, from a retracted position toward a driven position, determining a pressure of pressurized gas in a storage chamber cylinder of the gas spring mechanism, and indicating to a user of the fastener driver when the determined pressure in the storage chamber cylinder is less than a predetermined pressure value.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
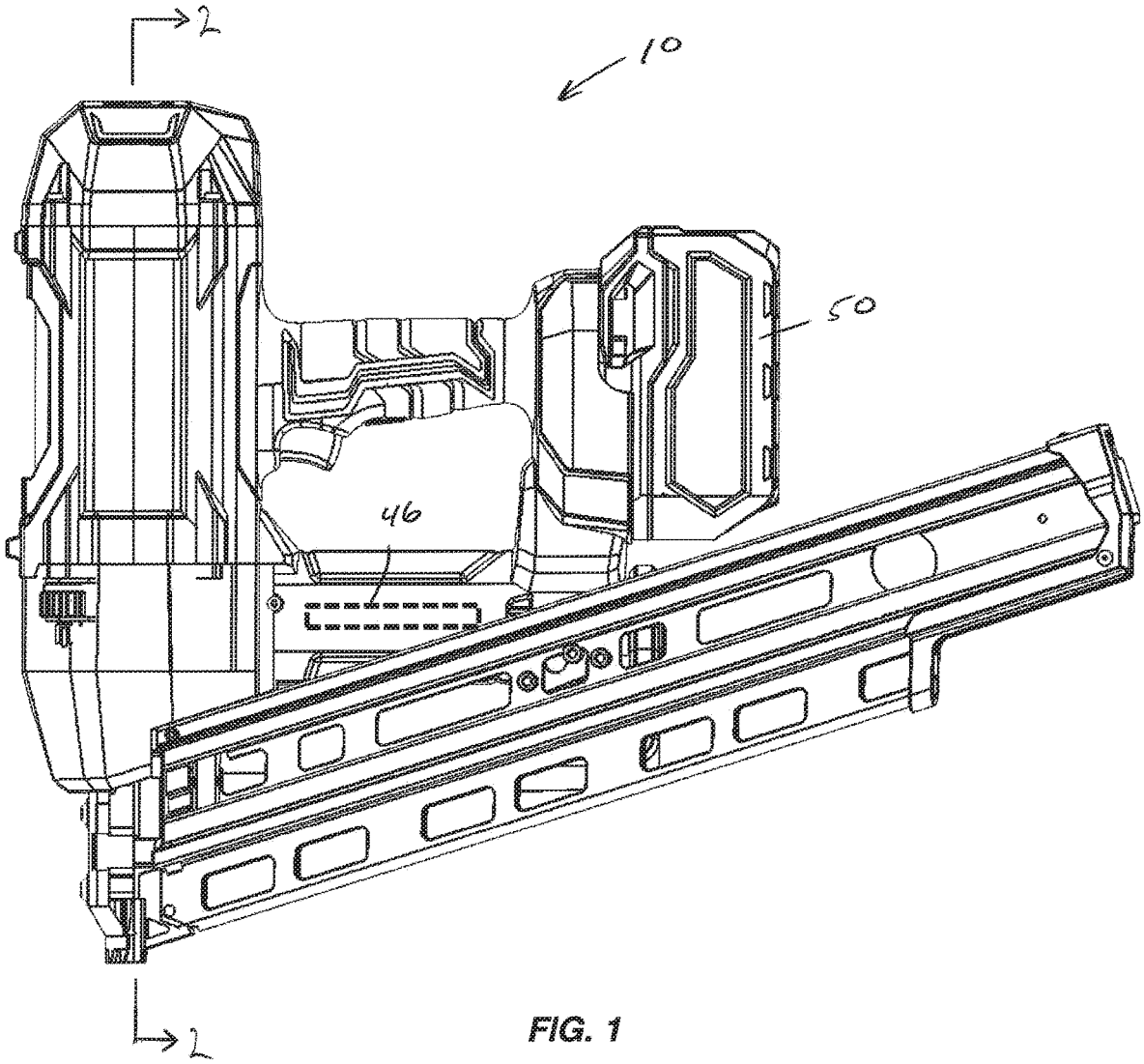
FIG. 1 is a side view of a gas spring fastener driver in accordance with an embodiment of the invention
Figure 2:
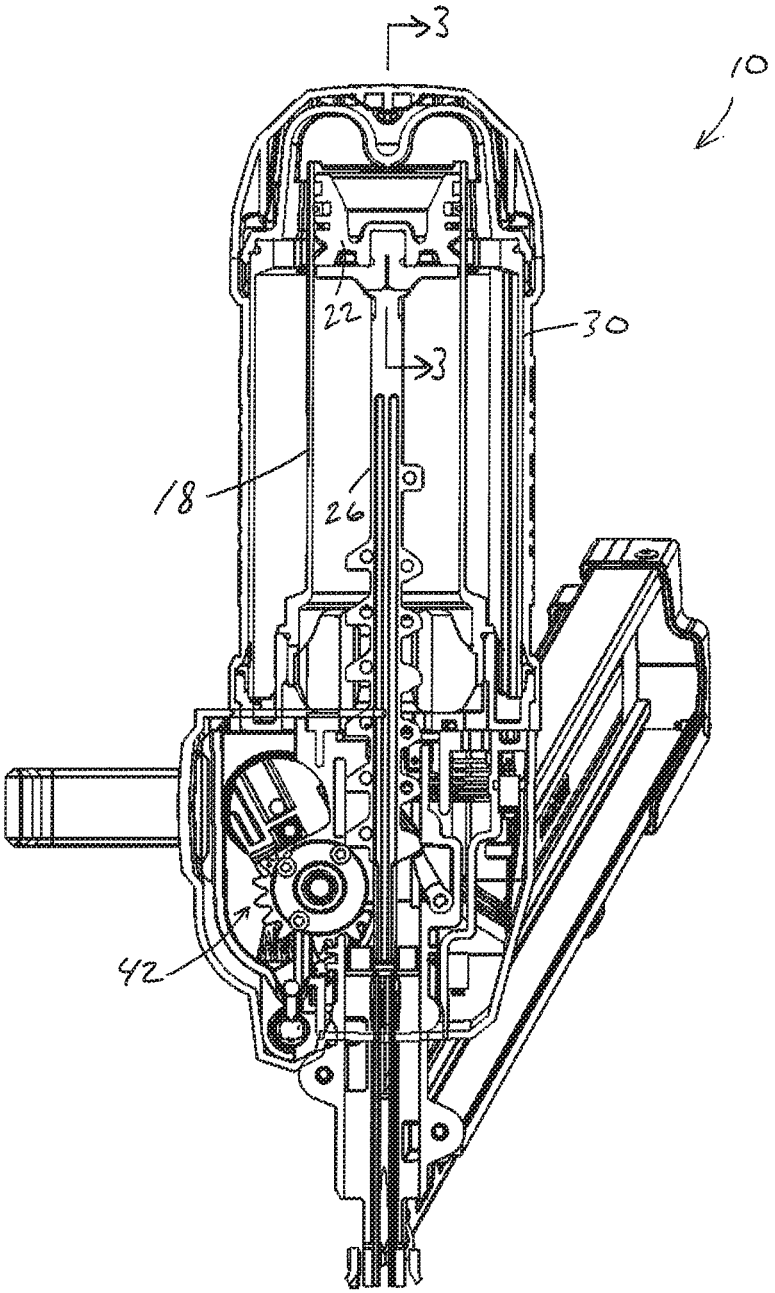
FIG. 2 is a cross-sectional view of the gas spring fastener driver of FIG. 1 along line 2-2 in FIG. 1.

With reference to FIGS. 1 and 2, a gas spring-powered fastener driver 10 is operable to drive fasteners (e.g., nails, tacks, staples, etc.) held within a magazine (not shown) into a workpiece. The fastener driver 10 includes a cylinder 18 (FIG. 2) and a moveable drive piston 22 positioned within the cylinder 18. The fastener driver 10 also includes a driver blade 26 that is attached to the piston 22 for movement therewith. The fastener driver 10 does not require an external source of air pressure, but rather includes a storage chamber cylinder 30 of pressurized gas (e.g., compressed air) in fluid communication with a portion of the cylinder 18 above the drive piston 22. The portion of the cylinder 18 beneath the drive piston 22, however, is in fluid communication with ambient air at atmospheric pressure. In the illustrated embodiment, the cylinder 18 and driver piston 22 are positioned within and coaxial with the storage chamber cylinder 30.

Figure 3:
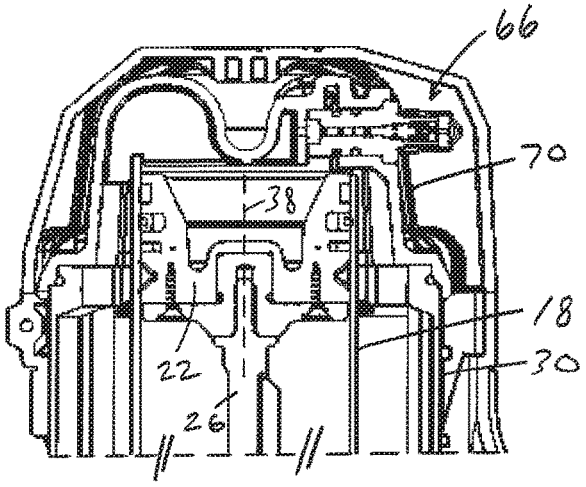
FIG. 3 is a cross-sectional view of a portion of the gas spring fastener driver of FIG. 1 along line 3-3 in FIG. 2.

With reference to FIGS. 2 and 3, the cylinder 18 and the driver blade 26 define a driving axis 38, and during a driving cycle the driver blade 26 and piston 22 are moveable between a retracted position (e.g., a top dead center position within the cylinder 18) and an extended, driven position (e.g., a bottom dead center position within the cylinder 18). As shown in FIG. 2, the fastener driver 10 further includes a lifter assembly 42, which is powered by a motor 46 (FIGS. 1 and 4), and which is operable to return the driver blade 26 and piston 22 from the driven position to a ready (i.e., retracted) position. A battery 50 (FIG. 1) is electrically connectable to the motor 46 for supplying electrical power to the motor 46. In alternative embodiments, the driver may be powered from an AC voltage input (i.e., from a wall outlet).

In operation of the fastener driver 10, the lifter assembly 42 drives the piston 22 and the driver blade 26 to the retracted or ready position by energizing the motor 46. As the piston 22 and the driver blade 26 are driven to the ready position, the gas above the piston 22 and the gas within the storage chamber cylinder 30 is compressed. Once in the ready position, the piston 22 and the driver blade 26 are held in position until released by user activation of a trigger (FIG. 1). When released, the compressed gas above the piston 22 and within the storage chamber 30 drives the piston 22 and the driver blade 26 to the driven position, thereby driving a fastener into a workpiece.

Figure 4:
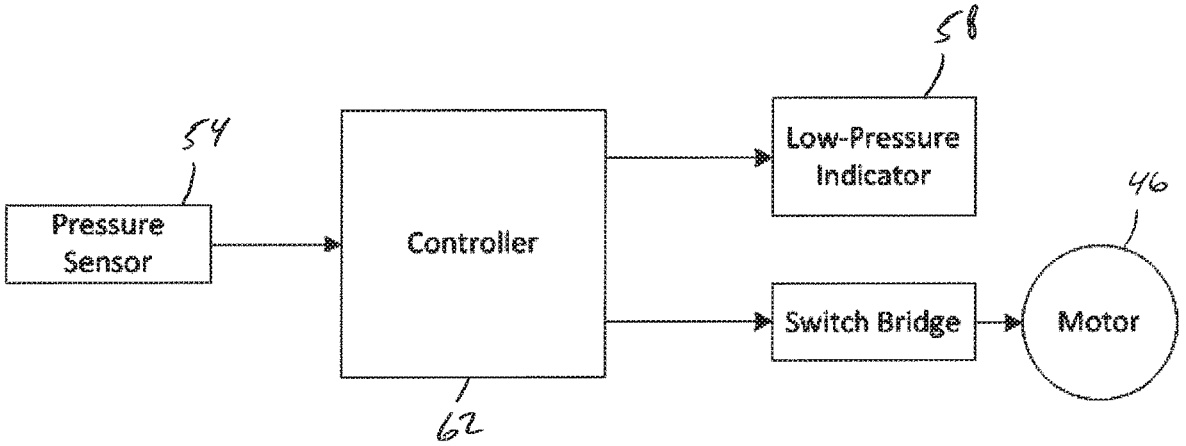
FIG. 4 is a schematic illustrating a control circuit of the gas spring fastener driver of FIG. 1.

As shown in FIG. 4, the fastener driver 10 includes a pressure sensor 54 (e.g., a pressure transducer or switch) to determine and/or detect the pressure of the compressed gas within the cylinders 18, 30 and a low-pressure indicator 58 (e.g., an LED) to alert the user of the fastener driver 10 of a low pressure condition in the cylinders 18, 30. More specifically, a controller 62 in the fastener driver 10 compares the output of the pressure sensor 54 to a predetermined threshold pressure, below which the controller 62 activates the indicator 58.

In some embodiments, the controller 62 may use other techniques to determine the pressure of the compressed gas in the cylinders 18, 30. For example, the controller 62 may monitor a current draw on the motor 46 when operating the lifter assembly 42 to return the driver blade 26 and piston 22 to the ready position which, using an algorithm, can calculate, estimate, or determine pressure in the cylinders 18, 30. When the controller 62 determines that the current (and/or power) draw on the motor 46 is below a predetermined threshold indicating that the pressure of compressed gas in the cylinders 18, 30 has fallen below a predetermined pressure threshold, the controller 62 may activate the low-pressure indicator 58 to provide a low-pressure alert to the user. In other words, the controller 62 is operable to correlate the current, voltage, and/or power, consumed by the motor 46 to a corresponding pressure value within the cylinders 18, 30.

With reference to FIG. 3, the fastener driver 10 further includes a fill valve 66 coupled to an end cap 70 of the storage chamber cylinder 30. The fill valve 66 is configured to be selectively connected with a gas fitting (not shown) which, in turn, is fluidly connected with a source of compressed gas (e.g., an air compressor, etc.). When connected with the source of compressed gas via the gas fitting, the fill valve 66 permits the storage chamber cylinder 30 to be refilled or recharged with compressed gas if prior leakage has occurred, as communicated to the user by activation of the low-pressure indicator 58. The storage chamber cylinder 30 may be filled to a desired pressure between approximately 90 psi and approximately 150 psi (e.g., approximately 120 psi). In some embodiments, the pressure may be less than 100 psi and greater than 150 psi. In some embodiments, the fill valve 66 may be configured as a Schrader valve. In other embodiments, the fill valve 66 is configured as a Presta valve, Dunlop valve, or other similar pneumatic fill valve. The fill valve 66 also allows a user to measure and check the pressure within the storage chamber cylinder 30 with any standard pressure gauge device.

Various features of the invention are set forth in the following claims.

What is claimed is:

1. A fastener driver comprising:

a driver blade movable from a retracted position to an extended, driven position for driving a fastener into a workpiece;

a gas spring mechanism for driving the driver blade from the retracted position to the driven position, the gas spring mechanism including a storage chamber cylinder containing a pressurized gas;

a lifter mechanism for moving the driver blade from the driven position toward the retracted position, the lifter mechanism including a motor; and a controller electrically connected to the motor and configured to:

monitor a current draw of the motor, correlate, using an algorithm stored in the controller, the current draw to a pressure value, compare the pressure value to a predetermined pressure value, and activate an indicator when the pressure value is less than the predetermined pressure value.

2. The fastener driver of claim 1, wherein the controller includes a comparator that compares the measured pressure value to the predetermined pressure value.

3. The fastener driver of claim 1, wherein the indicator is a light-emitting diode.

4. The fastener driver of claim 1, further comprising a fill valve coupled to an end cap of the storage chamber cylinder and configured to be selectively connected with a gas fitting fluidly connected to a source of compressed gas.

5. The fastener driver of claim 4, wherein when the fill valve is connected to the gas fitting, the fill valve permits the storage chamber cylinder to be refilled or recharged with compressed gas.

6. The fastener driver of claim 4, wherein the fill value is configured to be coupled to a standard pressure gauge device for measurement of pressure within the storage chamber cylinder.

7. The fastener driver of claim 5, wherein the controller is further configured to deactivate the indicator in response to the pressure value exceeding the predetermined pressure value caused by the storage chamber cylinder being refilled or recharged.

8. The fastener driver of claim 1, wherein the predetermined pressure value is between 90 psi and 150 psi.

9. A method of operating a fastener driver, the method comprising:

initiating a fastener driving operation by moving a driver blade, with a gas spring mechanism, from a retracted position toward a driven position;

determining a pressure value associated with of pressurized gas in a storage chamber cylinder of the gas spring mechanism, wherein determining the pressure value includes:

monitoring a current draw of a motor, the motor being operable to move the driver blade from the driven position toward the retracted position, estimating the pressure value of the pressurized gas in the storage chamber cylinder based on correlating the current draw to the pressure value using an algorithm stored in a controller; and indicating to a user of the fastener driver when the pressure value in the is less than a predetermined pressure value.

10. The method of claim 9, further comprising comparing, using the controller, the pressure value to the predetermined pressure value.

11. The method of claim 9, wherein indicating to the user of the fastener driver when the measured pressure value in the storage chamber cylinder is less than the predetermined pressure value includes activating a light-emitting diode.

12. The method of claim 9, further comprising refilling the storage chamber cylinder with compressed gas when a fill valve of the fastener driver is connected to a gas fitting.

13. The method of claim 12, further comprising deactivating the indicator in response to the pressure value exceeding the predetermined pressure value caused by refilling the storage chamber cylinder with compressed gas.

14. The method of claim 9, wherein the predetermined pressure value is between 90 psi and 150 psi.

* * * * *